US010272702B2

(12) United States Patent
Campanini

(10) Patent No.: US 10,272,702 B2
(45) Date of Patent: Apr. 30, 2019

(54) PRINTING APPARATUS

(71) Applicant: CUSTOM S.p.A., Fontevivo (Parma) (IT)

(72) Inventor: Alberto Campanini, Fidenza (IT)

(73) Assignee: CUSTOM S.p.A., Fontevivo (Parma) (IT)

( * ) Notice: Subject to any disclaimer, the term of this patent is extended or adjusted under 35 U.S.C. 154(b) by 0 days.

(21) Appl. No.: 15/577,576

(22) PCT Filed: Jun. 8, 2016

(86) PCT No.: PCT/IB2016/053345
§ 371 (c)(1),
(2) Date: Nov. 28, 2017

(87) PCT Pub. No.: WO2016/199026
PCT Pub. Date: Dec. 15, 2016

(65) Prior Publication Data

US 2018/0134052 A1 May 17, 2018

(30) Foreign Application Priority Data

Jun. 10, 2015 (IT) ..... 102015000022435

(51) Int. Cl.
*B26D 5/20* (2006.01)
*B41J 11/70* (2006.01)
(Continued)

(52) U.S. Cl.
CPC ..... *B41J 11/70* (2013.01); *B26D 1/085* (2013.01); *B26D 1/095* (2013.01); *B26D 5/00* (2013.01);
(Continued)

(58) Field of Classification Search
CPC ..... B41J 11/70; B41J 11/006; B41J 11/703; B26D 5/086; B26D 1/095; B26D 1/085;
(Continued)

(56) References Cited

U.S. PATENT DOCUMENTS 5,505,552 A * 4/1996 Hasegawa ..... B41J 3/24 101/93.07
5,971,639 A 10/1999 Park
2011/0008091 A1 1/2011 Tsukada

FOREIGN PATENT DOCUMENTS

EP 0870621 A2 * 10/1998 ..... B26D 1/30

OTHER PUBLICATIONS

International Search Report & Written Opinion of the International Searching Authority Application No. PCT/IB2016/053345 Completed Date: Sep. 20, 2016; dated Sep. 30, 2016 9 pages.

* cited by examiner

*Primary Examiner* — Yaovi M Ameh
(74) *Attorney, Agent, or Firm* — Whitmyer IP Group LLC

(57) ABSTRACT

A printing apparatus is disclosed, in which a printed document is separated from a continuous strip of paper by a blade driven by a reversible motor that has a forward rotation direction, in normal operation, and a backward rotation direction, for blade unlocking in the event of jamming of the blade, in which the backward rotation first has a free initial portion without transmitting force to the blade, then a tooth carried by the motor shaft knocks against another tooth carried by a hub of a gear that transmits force to the blade, unlocking the jam thereof.

19 Claims, 9 Drawing Sheets

(51) Int. Cl.

| | |
|---|---|
| ***B26D 1/08*** | (2006.01) |
| ***B26D 1/09*** | (2006.01) |
| ***B26D 5/00*** | (2006.01) |
| ***B26D 5/08*** | (2006.01) |
| ***B41J 11/00*** | (2006.01) |
| ***B65H 35/06*** | (2006.01) |
| *B26D 1/00* | (2006.01) |
| *B26D 7/00* | (2006.01) |

(52) U.S. Cl.
CPC ..... *B26D 5/08* (2013.01); *B26D 5/086* (2013.01); *B26D 5/20* (2013.01); *B41J 11/006* (2013.01); *B41J 11/703* (2013.01); *B65H 35/06* (2013.01); *B26D 2001/0066* (2013.01); *B26D 2007/005* (2013.01)

(58) Field of Classification Search
CPC ... B26D 5/20; B26D 5/08; B26D 5/00; B26D 2007/005; B26D 2001/0066; B65H 35/06
See application file for complete search history.

PRINTING APPARATUS

TECHNICAL FIELD

The invention relates to a printing apparatus, in particular for printing documents that are separated from a strip by a motor-driven blade. Specifically, but not exclusively, the invention can be applied to dispense printed documents such as for example tickets, payment slips, receipts, coupons, vouchers, etc., printed on a strip and then separated from the strip.

BACKGROUND

The prior art comprises printing apparatuses provided with a motor-driven cutting device that separates the printed documents from a continuous strip.

One of the problems of known printing apparatuses is the undesired lock of the apparatus due to a jam of the motor-driven blade. This jam may be due, for example, to the malfunction of the cutting device, to the use of unsuitable paper, an incorrect advancement of the paper, etc.

The jam may be so persistent as not to be solvable by simple retrograde driving of the electric driving motor for driving the blade. In these cases, the manual intervention of an operator is necessary who, with a finger, moves an emergency wheel that protrudes from the case of the printing apparatus and drives the cutting device backwards to solve the jam.

The problem of the jam can be burdensome, in particular, for printing apparatuses having a lid that carries the stationary blade of the cutting device. In fact, if the movable blade jams in an advanced position in which it partially overlaps the stationary blade, lifting the lid may be hindered by the locked movable blade and/or lead to damage to the cutting device.

SUMMARY

One object of the invention is to make a printing apparatus that is able to overcome one or more of the aforesaid limits and drawbacks of the prior art.

One advantage is to devise a printing apparatus with a system for unlocking an undesired arrest situation of a motor-driven cutting device that separates a printed document from a strip.

One advantage is to solve efficiently a jam situation of the blade of the cutting device used in the printing apparatus.

One advantage is to provide an automated unlocking system that does not require the manual intervention of an operator.

One advantage is to provide a constructionally simple and cheap system for solving a jam of the blade.

Such objects and advantages and still others are achieved by the printing apparatus according to one or more of the following claims.

In one embodiment, a printing apparatus comprises a blade, arranged for separating a printed document from a strip, and a reversible motor that drives the blade using a motion transmitting mechanism; the motor has a rotor with a forward rotation direction, for driving document cutting in a normal situation, and a backward rotation direction, for driving in a blade lock situation; backward rotation has an initial free portion, in which a portion of the mechanism moves freely, for a fraction of the rotation of the rotor, without transmitting force to the blade, acquiring kinetic energy that is sufficient to unlock the blade through the effect of a subsequent impact against another portion of the mechanism connected to the blade.

BRIEF DESCRIPTION OF THE DRAWINGS

The invention can be better understood and implemented with reference to the attached drawings that illustrate some non-limiting embodiments thereof.

DETAILED DESCRIPTION

Figure 2:
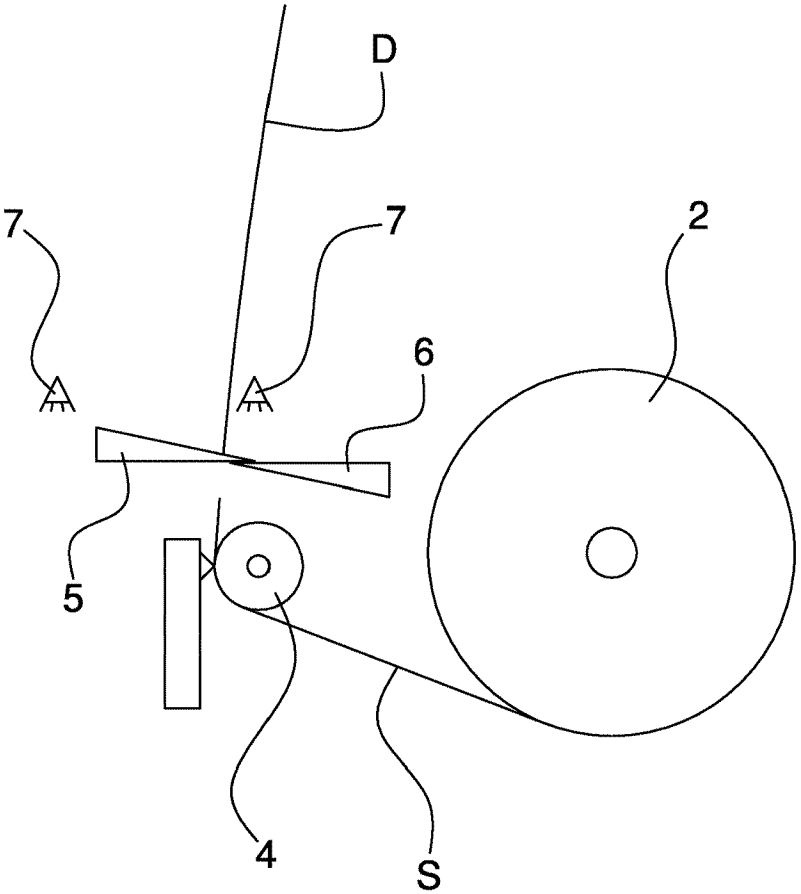
FIG. 2 is the diagram of FIG. 1 with the document that has just been separated from the strip by a cutting device.

In the aforesaid figures, identical elements of the various embodiments have been indicated for the sake of simplicity by the same numbering.

With reference to the aforesaid figures, overall with 1 a printing apparatus has been indicated that is usable in particular for printing tickets, payment slips, receipts, vouchers, coupons, or another type of printed document in real time.

The printing apparatus 1 may comprise, in particular, a magazine for housing printing paper or any other type of printing support. The printing support usable by the printing apparatus 1 in question may be, in particular, paper, for example thermal paper. In this patent document, "paper" is defined as any type of printing support that is suitable for printing (in particular with a thermal printing head or inkjet), for example a printable material in the form of a strip, in particular wound on a reel, like a reel for (thermal) paper. In this patent document, "strip" is defined not only as a strip of paper unwound from a reel but also other types of printing supports (of known type) like, for example, a set of sheets in continuous fan-fold format, or a set of sheets (for example labels) arranged in a row on a support in the form of strip, etc.

In the specific case the magazine may comprise, in particular, at least one seat arranged for receiving at least one reel 2 of (thermal) paper. The magazine may nevertheless comprise other embodiments of paper magazines (also of known type).

The printing apparatus 1 may comprise, for example, a containing body, or casing, (for example in box form) suitable for containing the various components of the printing apparatus or at least a part thereof.

The printing apparatus 1 may comprise, in particular, a path for feeding a continuous strip S of paper coming from the magazine (in this case a strip S unwound from the reel 2) to a cutting zone of the printed document D.

The printing apparatus 1 may comprise, in particular, a printing device for printing a document on the strip of paper that advances (unwound from the reel 2). The printing device may comprise, for example, a printing head 3 (thermal, inkjet or other) arranged along the path of the paper strip S for printing at least on a first face of the paper (for example a thermally sensitive face). In the specific case a thermal printing head 3 is arranged, but it is possible to provide for the use of an ink jet printing device or of yet another type of printing device.

A printing roller 4 (paper dragging roller) opposite the printing head 3 may be operationally associated with the printing head 3. The printing roller 4 may operate in contact with a second face of the paper (opposite the first printable face). The path of the strip S of paper passes, in particular, between the printing head 3 and the printing roller 4. The printing roller 4 may be controlled (by a programmable electronic controller, which is not illustrated) in cooperation with the printing head 3, to advance the strip S in a coordinated manner during the step of printing the document D.

The printing apparatus 1 may comprise, in particular, a cutting device for separating the printed document D from the rest of the strip S when the document D is (stationary) in a cutting zone (FIG. 2). The cutting device may comprise, for example, a motor-driven movable blade 5 cooperating with a stationary blade 6.

Figure 1:
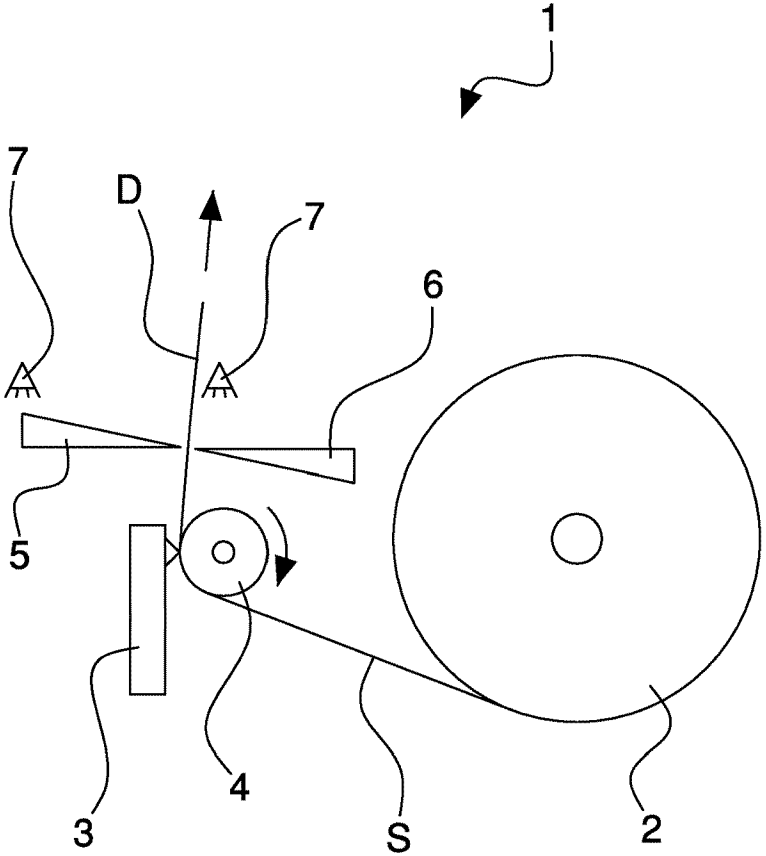
FIG. 1 is a diagram of a printing apparatus during printing of a document on a strip that advances.
Figure 4:
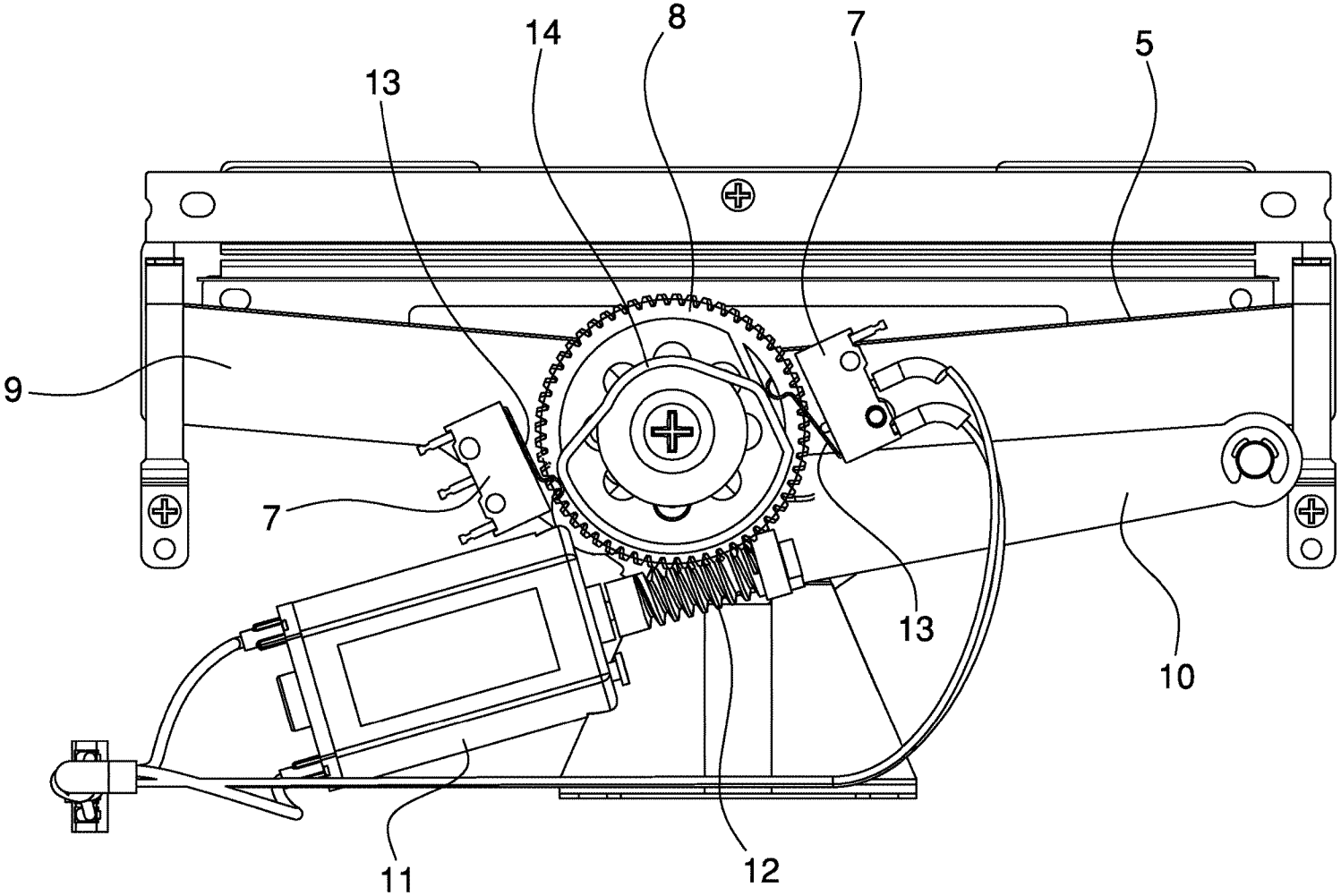
FIG. 4 shows another embodiment of a cutting device that is suitable for the printing apparatus of FIG. 1, with the device in a rest position.
Figure 5:
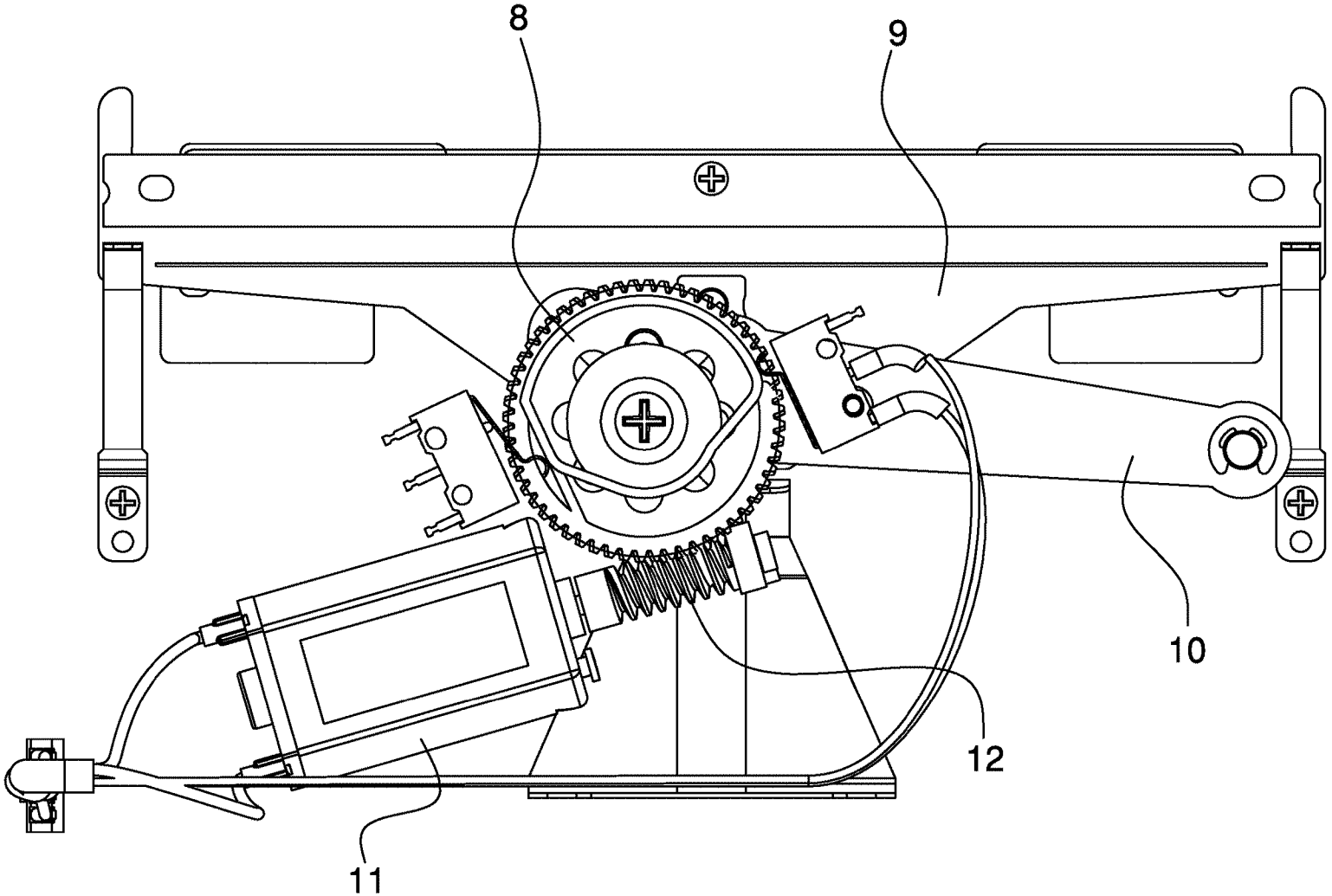
FIG. 5 shows the device of FIG. 4 in a cutting position.

The cutting device may be arranged for adopting at least a first (rest, FIGS. 1, 3, 4) configuration and at least a second (cutting or work, FIGS. 2, 5) configuration. In the first configuration the movable blade 5 is retracted and distant from the stationary blade 6, leaving free (between the blade 5 and the blade 6) a space for the passage of the printed document D to the cutting zone where the printed document D stops to be separated from the rest of the strip S. In the second configuration the movable blade 5 is advanced and partially overlaps the stationary blade 6, obstructing the aforesaid space (between the blade 5 and the blade 6).

The printing apparatus 1 may comprise, in particular, sensor means 7 arranged for signaling when the cutting device is in the first (rest) configuration and/or for signaling when the cutting device is in the second (cutting) configuration. The sensor means 7 may comprise, as in the embodiment in FIGS. 4 and 5, a first switch that opens or closes when the cutting device is in the second configuration. The sensor means 7 may comprise, as in the embodiment in FIGS. 4 and 5, a second switch that opens or closes when the cutting device is in the second configuration.

The second switch may be arranged, in particular, for emitting a signal (for example a closed or open switch electric signal) after the cutting device has separated a document D from the rest of the strip S and before the cutting device returns to a configuration (for example the first rest configuration) that is suitable for permitting the advancement of the strip S for printing a new document D through the space between the blades 5 and 6.

The first switch may be arranged, in particular, for emitting a signal (for example a closed or open switch electric signal) at the moment in which the cutting device, after separating a document D from the rest of the strip S, has returned to a configuration (for example the first rest configuration) that is suitable for enabling the strip S to advance for the printing of a new document D.

As in the embodiment disclosed here, the cutting device may comprise a first element 8 with rotary motion and a second element 9 with reciprocal motion that receives the motion from the first element 8. The second element 9 carries the movable blade 5. The first element 8 may be connected to the second element 9 by a mechanism that transforms rotary motion into reciprocal motion, for example a mechanism of the crank and slotted link type with a rocker arm 10 (as in this embodiment), of the connecting rod and crank type or yet another type.

The cutting device may comprise, as in the embodiments of FIGS. 3 to 9, an (electric) motor 11 having a rotor connected (coaxially) to a worm screw 12 connected mechanically to the first rotating element 8.

The sensor means 7 may be operationally associated with the first element 8 (as in this embodiment) and/or with the second element 9 and/or directly with the movable blade 5.

In particular, the sensor means 7 (first and/or second switch) may comprise an elastic element 13 (for example in the shape of an arm) engaged with a cam profile 14 arranged on the first element 8. The elastic element 13 may act, as in this case, on a button of an electric contact.

In the specific embodiment, the sensor means 7 comprises at least one presence or proximity sensor (a switch). In the specific embodiment, the sensor means 7 comprises at least one sensor of mechanical type (a switch). It is nevertheless possible to provide for the use of other types of sensor, for example at least one sensor of optical type, of magnetic type, of ultrasound type, etc., which is able to detect when the cutting device is in the first and/or in the second configuration.

The printing apparatus 1 may comprise, in particular, the aforesaid control means (programmable electronic controller), comprising for example at least one electronic card connected to sensors and actuators of the printing apparatus.

Figure 3:
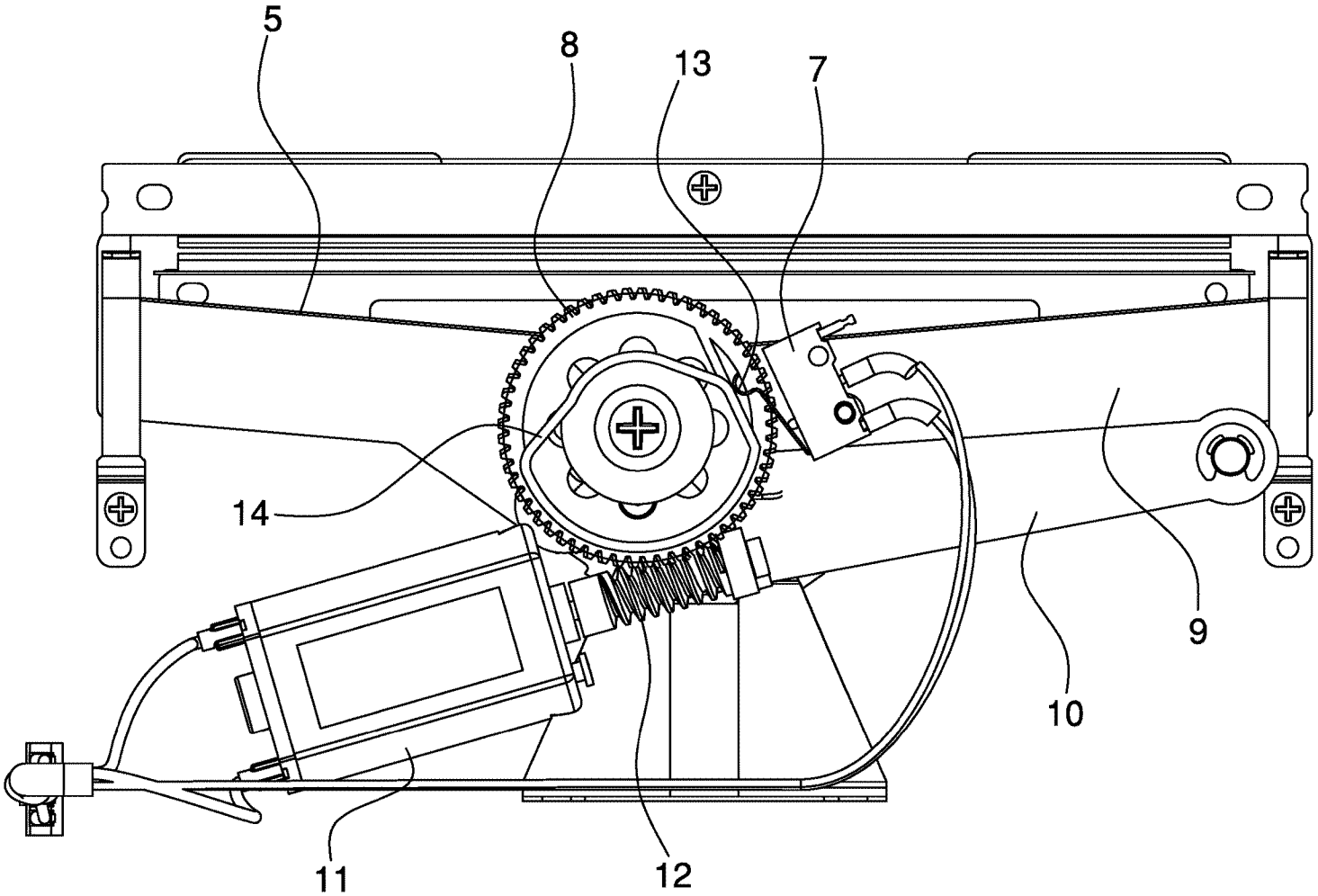
FIG. 3 shows one embodiment of a cutting device that is suitable for the printing apparatus of FIG. 1, with the device in a rest position.

With reference to FIG. 3, one embodiment is illustrated in which the sensor means 7 that detects the two configurations (paper path free and paper path occupied) of the cutting device comprises a single (presence or proximity, in particular switch) sensor. The sensor may comprise an elastic element 13 (for example in the shape of an arm) engaged with a shaped portion of the first element 8, for example a cam profile 14 arranged on the first element 8. The cam profile 14 may be shaped, as in the embodiment of FIG. 3, in such a manner as to induce a transition in the sensor (switch) when the cutting device arrives at the first rest configuration (paper path free) and a transition when it arrives at the second cutting configuration (paper path occupied). Each transition may comprise, in particular, a transition of the switch from ON to OFF or, vice versa, from OFF to ON. The cam profile 14 of the embodiment in FIG. 3 may have, in particular, a first (greater) diameter for a zone of the profile with an angular size of about half a revolution and a second diameter (less than the first) for the remaining angular size of half a revolution.

In use, when the cutting device reaches the cutting configuration (with the blade 5 advanced that occupies the passage of the paper), the single sensor has a transition that is used as a signal (for the control means) indicating that the cutting configuration has been reached. When the cutting device returns to the rest configuration (with the blade 5 retracted that does not occupy the passage of the paper), the single sensor has another transition that is used as a signal indicating that the rest configuration has been reached.

Below, some embodiments are disclosed of an unlocking device for unlocking the cutting device, in particular unlocking a jam of the blade 5.

The rotor of the motor 11 may be reversible with rotation in one direction, for driving the blade 5 in case of normal operation ("forward" rotation, FIGS. 6 and 9), and a rotation in the opposite direction ("backward" rotation, FIGS. 7 and 10), unlocking the blade, in the case of locking of the blade 5, for example due to jamming.

The unlocking device may comprise, as in these embodiments, a (reversible) mechanism that connects the rotor of the motor 11 to the blade 5. The mechanism may have, in particular, at least a first portion 15 connected (directly) to the rotor and at least one second portion 16 connected (indirectly) to the blade 5.

During the forward rotation (in the normal operation direction for cutting the document), the first portion 15 may be coupled (by obstacle, direct contact, or by a kinematic chain) with the second portion 16, whereby the motion can be transmitted to the blade 5. In case of locking of the blade 5, the rotor of the motor 11 may be rotated in the opposite direction (backward rotation), by the programmable electronic controller.

In an initial portion of the backward rotation, the first portion 15 of the mechanism may be decoupled from the second portion 16, such that the rotor does not drive the second portion 16 and thus the motion is not transmitted to the blade 5. In this initial step, by virtue of the decoupling between the first portion 15 and the second portion 16, the rotor may rotate freely, without obstacle from the second portion 16, without substantially transmitting force to the blade 5, so as to acquire kinetic energy that will be exploited to resolve the jam of the blade 5.

Continuing in the aforesaid backward rotation of the rotor, after rotating freely (substantially without interaction with an obstacle or a stop) for the aforesaid initial portion, the first portion 15 couples (by obstacle, in a shock relationship) with the second portion 16, in order that the rotor can also rotate the second portion 16 and thus the (retrograde) motion is transmitted to the blade 5.

The aforesaid free initial portion (without obstacle or abutment against the second portion 16), during which the rotor can acquire kinetic energy, may extend angularly, in particular, by an angle of at least 5° (sexagesimal degrees), or anyway by an angle of a size that is such as to acquire sufficiently great kinetic energy to generate an impact of the first portion 15 against the second portion 16 that is able to unlock the blade 5. The aforesaid initial portion may extend, for example, by an angle of at least 10°, or 20°, or 30°, or 45°, or 90°, or 180°.

The sensor means 7, which is arranged for detecting the operating configuration of the cutting device, may also be suitable for detecting a situation of locking of the blade, for example a situation in which the blade 5 remains stationary in an advanced position without being able to move back to a rest position.

The mechanism that connects the motor 11 to the blade 5 (in particular comprising a mechanism for transforming a continuous rotary motion of the rotor into a reciprocal motion of the blade) may comprise, as said, at least one wheel gear, for example a worm screw 12 (embodiment in FIGS. 6 to 8), a straight cylindrical wheel 17 (embodiments in FIGS. 9 to 14), a bevel wheel, etc., mounted on a rotating shaft, for example on the rotor of the motor 11, with the interposition of a bearing 18, for example a sliding bearing, mounted (by friction) on the aforesaid shaft.

The first portion 15 and the second portion 16 may be, as in these embodiments, integral, respectively, with the bearing 18 and with the wheel gear (12 or 17).

The bearing 18 may be made of a material with a low friction coefficient, for example of plastics (PTFE), metal (tin-based alloy), etc. The wheel gear 12 or 17 may be made of plastics, metal or another material. The first portion 15 and/or the second portion 16 may be made of plastics, metal or another material.

Figure 10:
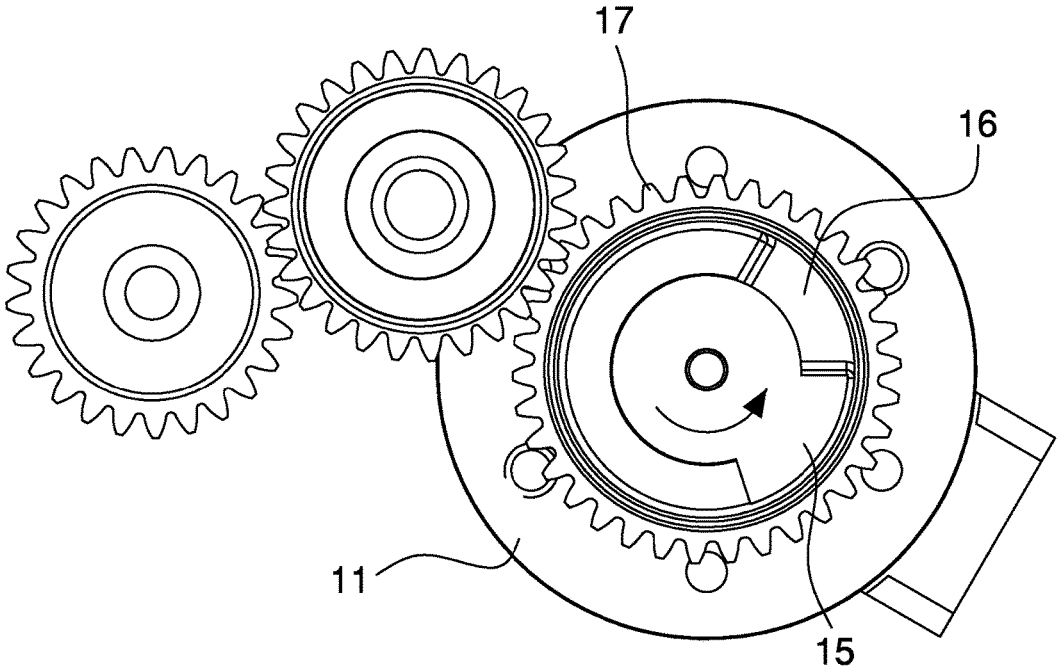
FIG. 10 is the view of FIG. 9 with the jam unlocking system in an unlocking configuration, with rotation of the rotor in the opposite direction.
Figure 11:
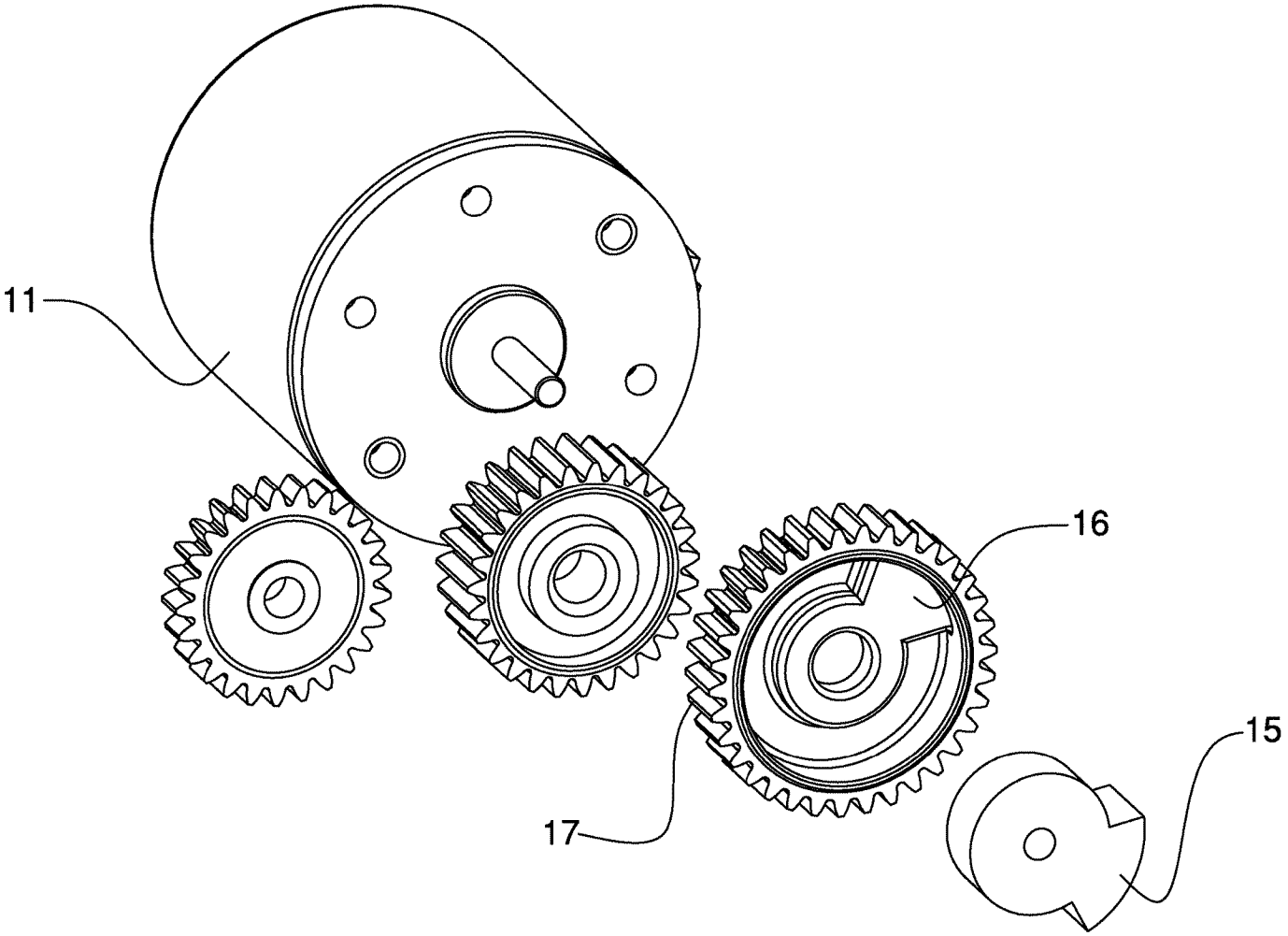
FIG. 11 is an exploded view of the unlocking system in FIG. 9.

The first portion 15 may comprise, as in these embodiments, at least one first tooth with two opposite sides, each of which engages the second portion 16. In particular, a side of the first tooth engages the second portion 16 (as an abutment or obstacle) during the forward rotation (FIGS. 6 and 9), whilst the other side of the first tooth engages the second portion 16 (as an abutment or obstacle) during the backward rotation (FIGS. 7 and 10).

The second portion 16 may comprise, as in these embodiments, at least one second tooth with two opposite sides, each of which engages the first portion 15. In particular, one side of the second tooth engages the first portion 15 (in an abutment or obstacle relationship) during the forward rotation (FIGS. 6 and 9), whilst the other side of the second tooth engages the first portion 15 (in an abutment or obstacle relationship) during the backward rotation (FIGS. 7 and 10).

In the embodiments of FIGS. 6 to 11, the first portion 15 comprises a tooth and the second portion 16 comprises a tooth.

Figure 12:
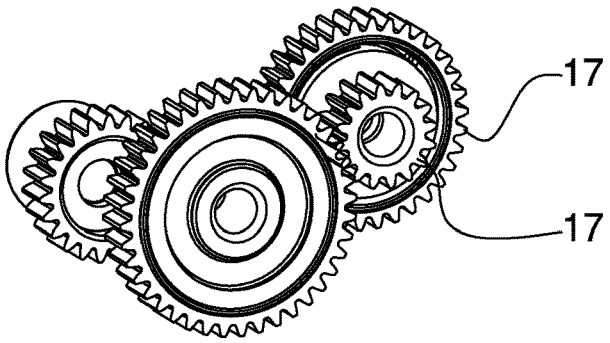
FIG. 12 is a view of a third embodiment of a jam unlocking system, made according to the invention, for unlocking a cutting device for a printing apparatus.
Figure 13:
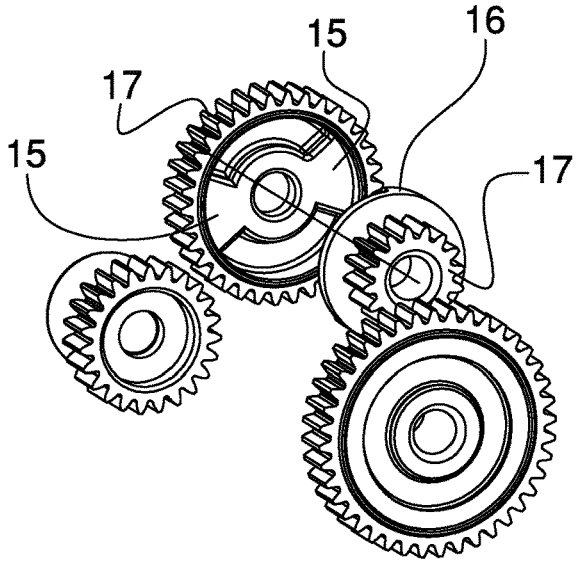
FIG. 13 is an exploded view of the unlocking system in FIG. 12.
Figure 14:
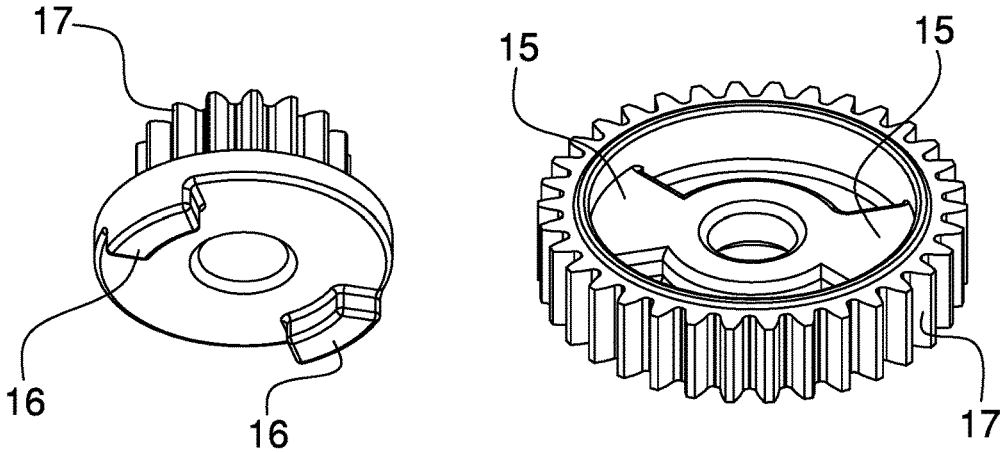
FIG. 14 shows the first portion 15 and the second portion 16 of the unlocking system in FIG. 12.

In the embodiment in FIGS. 12 to 14, the first portion 15 comprises a pair of teeth and the second portion 16 comprises a pair of teeth, in which the teeth of one portion are inserted into the spaces comprised between the teeth of the other portion.

In the embodiments disclosed here, during the rotation of the rotor backwards, there is an initial rotation portion in which the first portion 15 rotates freely, without being hindered by the second portion 16, as the first portion 15 and the second portion 16 are not mutually engaged (in an abutment or obstacle relationship). The first portion 15 and the second portion 16 may be coaxial with one another and be arranged at a certain reciprocal angular distance. This angular distance between the first portion 15 and the second portion 16 may enable, at the start of the backward rotation of the rotor, a rotation portion to be obtained in which the first portion 15 is not engaged with the second portion 16, so the motion transmitting mechanism is momentaneously interrupted (for at least 5° of rotation of the rotor) and thus the blade 5 does not substantially receive force from the rotor.

The first portion 16 may comprise, in particular, first engagement means and the second portion may comprise, in particular, second engagement means. The first engagement means may be engaged (in an abutment or obstacle relationship) against a first side of the second engagement means for transmitting the aforesaid forward rotation. The first engagement means may be engaged (in an abutment or obstacle relationship) against a second side (opposite the aforesaid first side) of the second engagement means for transmitting the aforesaid backward rotation.

The first portion 15 may comprise, as in these embodiments, a shaft portion. The second portion 16 may comprise, as in these embodiments, a hub portion that is coaxial with the aforesaid shaft portion. The first portion 15 may comprise, as in these embodiments, a portion that is rotatable around a rotation axis coinciding with an axis of the rotor of the motor 11. The first portion 15 may comprise, as in these embodiments, a rotatable portion that is coaxial with a rotatable portion of the second portion 16.

In the specific embodiments disclosed here, the first portion 15 and the second portion 16 work by obstacle and are substantially subjected to a cutting force, with the sides of a portion that adhere to the sides of the other portion, changing sides alternatingly according to the rotating direction of the rotor of the motor 11.

The blade 5 unlocking device may comprise, as in these embodiments, coupling means between a shaft portion and a hub portion. Such coupling means may work, in particular, by obstacle, allowing in a retrograde rotation portion of the shaft portion the coupling means to be disconnected in order that the shaft portion can accumulate kinetic energy.

The aforesaid coupling means, in the embodiments disclosed here, comprises two portions 15 and 16 in the form of protruding teeth that engage one another. It is possible to provide for the use of other coupling means, for example in the form of tab means, grooved profile means, etc.

Figure 6:
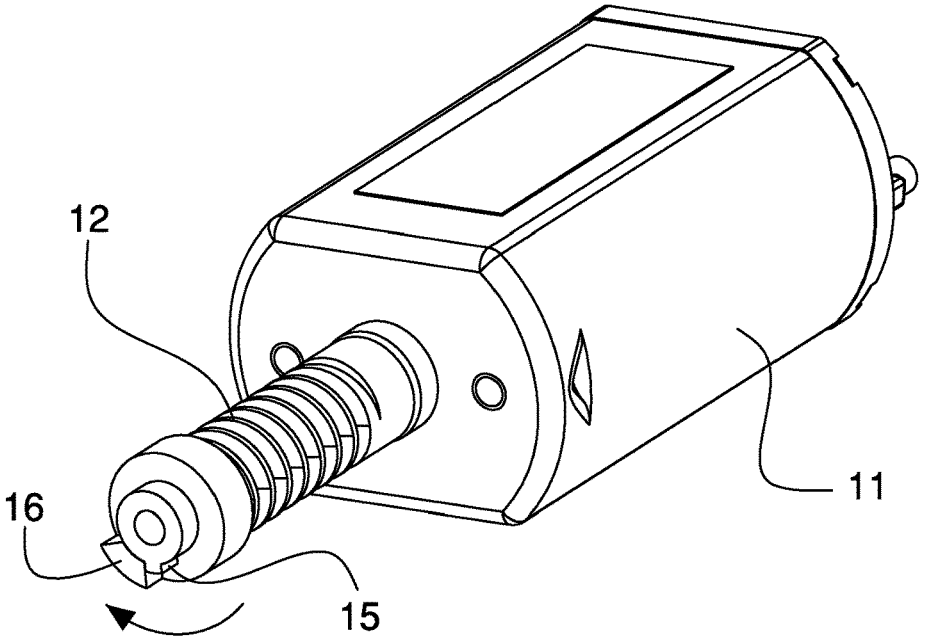
FIG. 6 is a view of a first embodiment of a jam unlocking system, made according to the invention, for unlocking a cutting device for a printing apparatus, in a normal operation configuration of document cutting, with rotation in a rotor direction.
Figure 7:
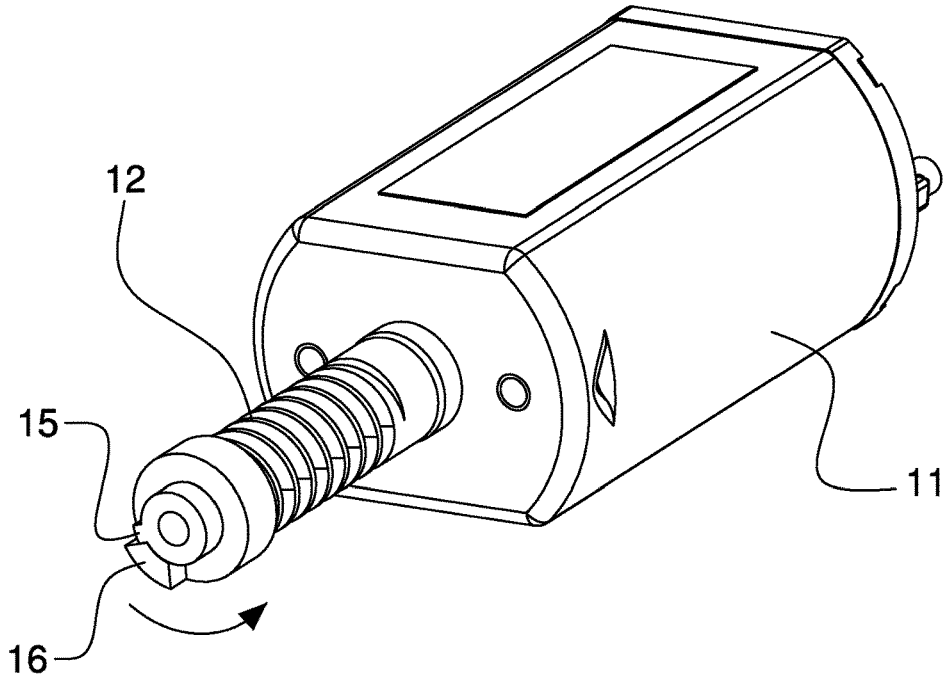
FIG. 7 is the view of FIG. 6 with the jam unlocking system in an unlocking configuration, with rotation of the rotor in the opposite direction.
Figure 8:
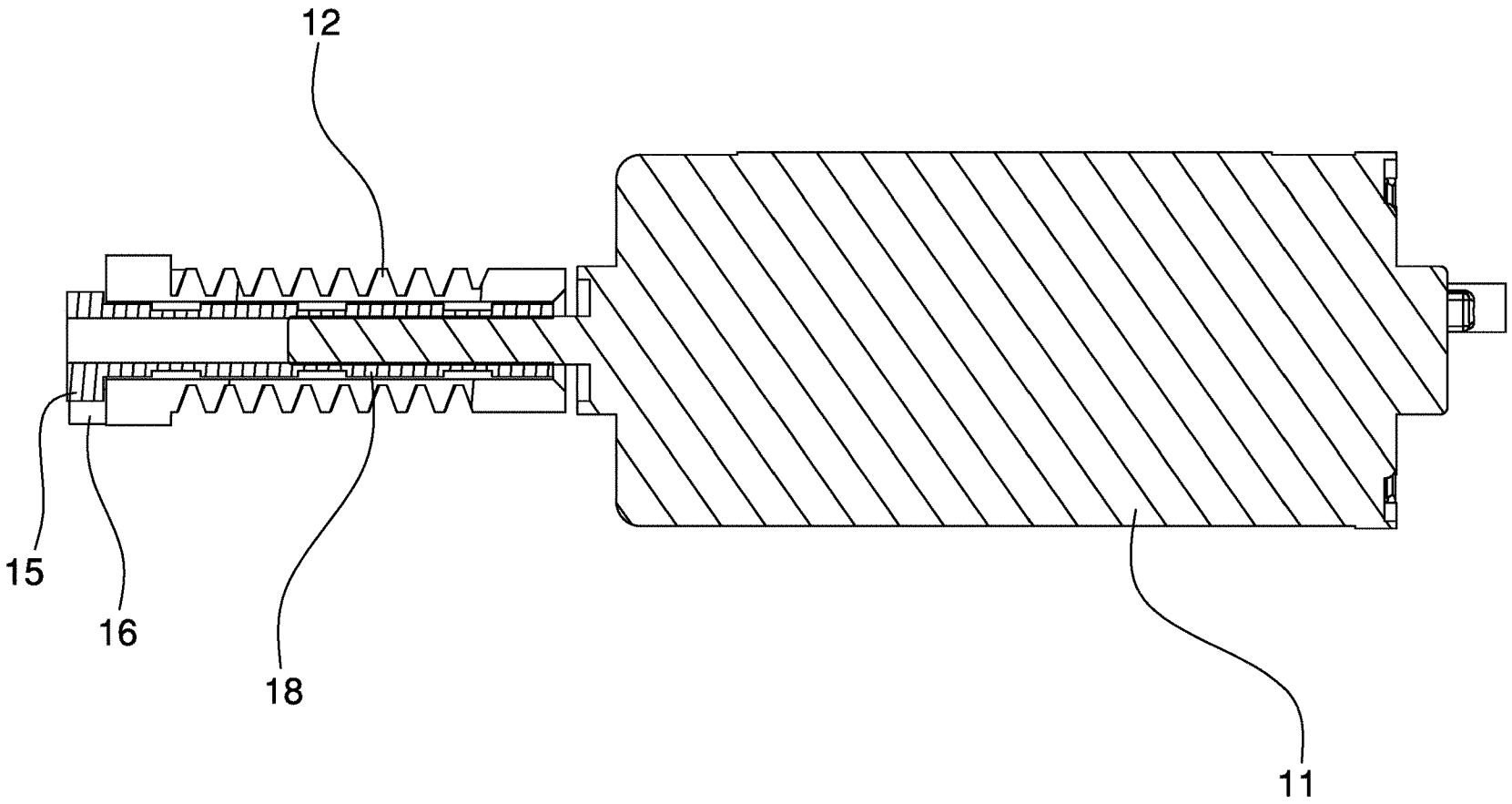
FIG. 8 is a section of the unlocking system of FIG. 6.
Figure 9:
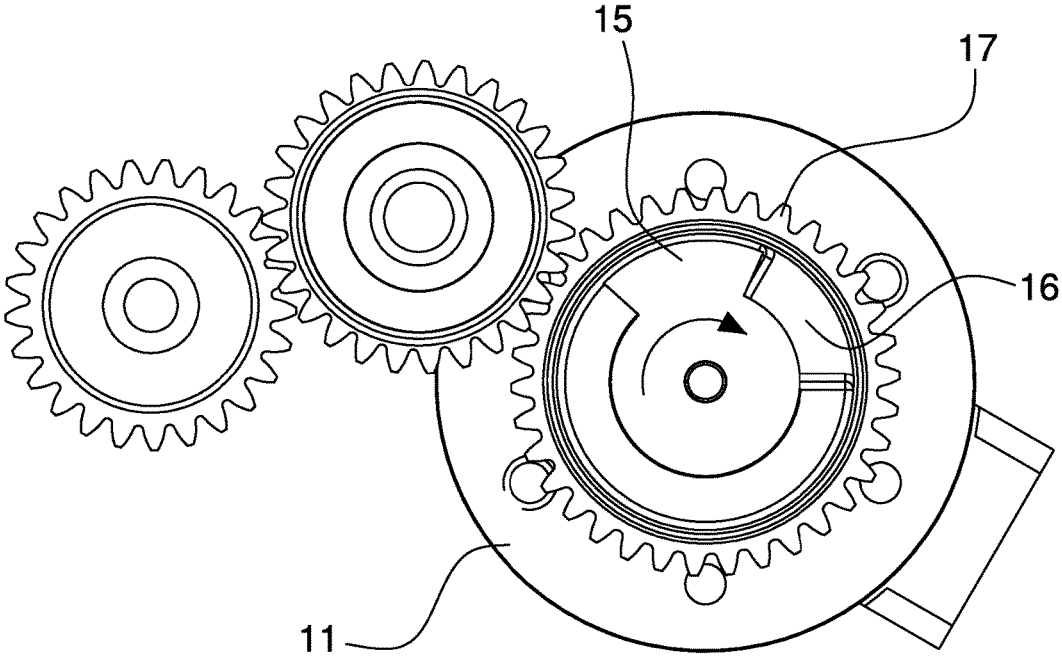
FIG. 9 is a view of a second embodiment of a jam unlocking system, made according to the invention, for unlocking a cutting device for a printing apparatus, in a normal operation configuration of document cutting, with rotation in a rotor direction.

In the embodiment in FIGS. 6 to 8, the blade 5 unlocking device is applied to a cutting device with a motion transmitting mechanism that comprises a worm screw 12. In the embodiments of FIGS. 9 to 14, the blade 5 unlocking device is applied to a cutting device with a motion transmitting mechanism that comprises a set of cylindrical wheel gears with straight teeth. It is possible to arrange an unlocking device for unlocking the blade also in other types of cutting devices that are suitable for separating printed documents from a continuous strip in printing apparatuses for payment slips, receipts, tickets, etc.

The control means operates in such a manner as to perform the following operations. The printing apparatus 1 prints a document D on the strip. The printed document reaches the cutting zone. The cutting device separates the document D (situated in the cutting zone) from the rest of the strip S.

In the case of a jam of the blade 5, the sensor means 7 signals to the control means that the blade 5 has not returned to the rest configuration. The control means is programmed to reverse the rotating direction of the motor 11 in response to a signal received from the sensor means. Through the effect of this reversal, the rotor of the motor 11 rotates backwards without obstacles by a significant free rotation portion (not less than at least 5°, or 10°, or 30°, or 45°, or 90°, or 180°), until the first portion 15 encounters the second portion 16 (on the opposite side), re-establishing the mechanical connection between the motor 11 and the jammed blade 5. Owing to the impact of the first portion 15 against the second portion 16, there is a significant force that acts on the blade 5, through the motion transmitting mechanism. This force, caused by the aforesaid impact, is able to solve the jam of the blade 5, which can move again.

The printing apparatus 1 may comprise, in particular, programme instructions that are implementable on this programmable controller to run the following steps of a printing method: printing a document on a strip that advances; separating the document from the strip by a cutting device; detecting when the cutting device is in a locked configuration (jam of the blade); driving the cutting device in a reverse manner to solve the lock of the cutting device.

Some embodiments of kinematic motions have now been disclosed that connect the motor to the blade driven by the motor and some embodiments have now been disclosed of the unlocking devices for unlocking the jam of the blade. It is nevertheless possible to provide other embodiments that are not illustrated of kinematic motions for transferring the kinetic energy of the motor to the blade, for example other types of gear transmissions (other than those disclosed before) or transmissions with mechanical members other than gears such as belts, pulleys, chains, levers, connecting rods etc. It is also possible to provide other types of blade unlocking devices that are arranged for temporarily removing the mechanical connection between the motor and the blade in the initial step of the retrograde motion of the motor to acquire sufficient kinetic energy in order that, when the connection is restored after the initial step of the retrograde motion, a shock is generated that is able to remove the jam: these other embodiments of blade unlocking devices may comprise, in particular, obstacle engaging means associated with two members of the kinematic motion that are other than those already disclosed, for example two non-rotating members, or a pulley and a timing belt, or a pinion and a transmission chain, etc.

The invention claimed is:

1. A printing apparatus comprising:

a printing device arranged for printing a document on a strip that advances along a path;

cutting means arranged for separating the document from the strip;

a reversible rotor with a forward rotation, for driving said cutting means in case of normal operation, and a backward rotation, to unlock said cutting means, in case of lock of said cutting means, for example due to jamming;

a mechanism that connects said rotor to said cutting means, said mechanism having at least one first portion connected to said rotor and at least one second portion connected to said cutting means;

in which:

in said forward rotation, said first portion is coupled with said second portion, whereby the motion is transmitted to said cutting means;

in an initial portion of said backward rotation, said first portion is decoupled from said second portion, whereby said rotor does not drive said second portion and the motion is not transmitted to said cutting means;

continuing said backward rotation, after said initial portion of backward rotation, said first portion is coupled with said second portion, whereby said rotor also drives said second portion and then the motion is transmitted to said cutting means;

said initial portion of backward rotation extends for an angle of at least 5° or anyway such as to determine an impact of said first portion against said second portion that is sufficient to unlock said cutting means:

said mechanism includes at least one wheel gear mounted on a rotating shaft with the interposition of a bearing mounted on said shaft, one of said first and second portions being integral with said bearing and the other with said wheel gear.

2. The printing apparatus according to claim 1, wherein said initial portion of backward rotation extends for an angle of at least 180°.

3. The printing apparatus according to claim 1, wherein said initial portion of backward rotation extends for an angle of at least 90°.

4. The printing apparatus according to claim 1, wherein said initial portion of backward rotation extends for an angle of at least 45°.

5. The printing apparatus according to claim 1, wherein said initial portion of backward rotation extends for an angle of at least 10°.

6. The printing apparatus according to claim 1, including a sensor means for detecting a locking situation of said cutting means.

7. The printing apparatus according to claim 1, wherein said rotating shaft comprises said rotor.

8. The printing apparatus according to claim 1, wherein said at least one wheel gear includes a worm screw or a straight cylindrical wheel and said bearing includes a sliding bearing.

9. The printing apparatus according to claim 1, wherein said first portion includes first engagement means and said second portion includes second engagement means, said first engagement means being selectively engaged with a first side of said second engagement means for transmitting said forward rotation by obstacle, or with a second side, opposite said first side, of said second engagement means for transmitting said backward rotation by obstacle.

10. The printing apparatus according to claim 1, wherein said first portion includes a shaft portion and said second portion includes a hub portion coaxial with said shaft portion.

11. The printing apparatus according to claim 1, wherein said first portion includes a portion that is rotatable around a rotation axis that is coincident with an axis of said rotor.

12. The printing apparatus according to claim 1, wherein said first portion includes a rotatable portion that is coaxial with a rotatable portion of said second portion.

13. The printing apparatus according to claim 1, wherein said first portion includes at least one first tooth with two opposite sides, each of which engages said second portion, one side in said forward rotation and the other side in said backward rotation.

14. The printing apparatus according to claim 1, wherein said mechanism includes a transmission which transforms a continuous rotary motion of said rotor into a reciprocating motion of a blade of said cutting means.

15. The printing apparatus according to claim 1, wherein said initial portion of backward rotation extends for an angle of at least 20°.

16. The printing apparatus according to claim 1, wherein said initial portion of backward rotation extends for an angle of at least 30°.

17. The apparatus according to claim 7, wherein said at least one wheel gear includes a worm screw or a straight cylindrical wheel and said bearing includes a sliding bearing.

18. The printing apparatus according to claim 1, wherein said second portion includes at least one second tooth with two opposite sides, each of which engages said first portion, one side in said forward rotation and the other side in said backward rotation.

19. A printing apparatus comprising:

a printing device arranged for printing a document on a strip that advances along a path;

cutting means arranged for separating the document from the strip;

a reversible rotor with a forward rotation, for driving said cutting means in case of normal operation, and a backward rotation, to unlock said cutting means, in case of lock of said cutting means, for example due to jamming;

a mechanism that connects said rotor to said cutting means, said mechanism having at least one first portion connected to said rotor and at least one second portion connected to said cutting means;

said mechanism includes at least one wheel gear mounted on a rotating shaft with the interposition of a bearing mounted on said shaft, one of said first and second portions being integral with said bearing and the other with said wheel gear;

a sensor means for detecting a locking situation of said cutting means; in which:

in said forward rotation, said first portion is coupled with said second portion, whereby the motion is transmitted to said cutting means;

in an initial portion of said backward rotation, said first portion is decoupled from said second portion, whereby said rotor does not drive said second portion and the motion is not transmitted to said cutting means;

continuing said backward rotation, after said initial portion of backward rotation, said first portion is coupled with said second portion, whereby said rotor also drives said second portion and then the motion is transmitted to said cutting means;

said initial portion of backward rotation extends for an angle of at least 1800 such as to determine an impact of said first portion against said second portion that is sufficient to unlock said cutting means;

in the case of a locking situation of the cutting means, the sensor means signals to a control means that the cutting means has not returned to a rest configuration, the control means being programmed to reverse the rotating direction of the rotor in response to a signal received from the sensor means;

through the effect of this reversal, the rotor rotates backwards without obstacles by a free rotation portion not less than 1800, until the first portion encounters the second portion on the opposite side, re-establishing the mechanical connection between the rotor and the cutting means whereby, owing to the impact of the first portion against the second portion, there is a significant force that acts on the cutting means through the mechanism, said force, caused by said impact, being able to solve the locking situation of the cutting means which can move again.

* * * * *